US009907393B2

(12) United States Patent
Rossi

(10) Patent No.: US 9,907,393 B2
(45) Date of Patent: Mar. 6, 2018

(54) AUTOMATED EXPANDABLE TABLE

(71) Applicant: Luis Mario Rossi, Dale City, CA (US)

(72) Inventor: Luis Mario Rossi, Dale City, CA (US)

( * ) Notice: Subject to any disclaimer, the term of this patent is extended or adjusted under 35 U.S.C. 154(b) by 0 days.

(21) Appl. No.: 15/624,519

(22) Filed: Jun. 15, 2017

(65) Prior Publication Data

US 2017/0360187 A1 Dec. 21, 2017

Related U.S. Application Data

(60) Provisional application No. 62/350,535, filed on Jun. 15, 2016.

(51) Int. Cl.

| | |
|---|---|
| ***A47B 1/02*** | (2006.01) |
| ***A47B 1/10*** | (2006.01) |
| ***A47B 13/08*** | (2006.01) |

(52) U.S. Cl.

CPC ..... *A47B 1/10* (2013.01); *A47B 13/081* (2013.01); *A47B 13/088* (2013.01); *A47B 1/02* (2013.01)

(58) Field of Classification Search

CPC .... A47B 1/00; A47B 1/10; A47B 1/02; A47B 1/04; A47B 1/05; A47B 2001/025; A47B 2001/053; A47B 13/081

See application file for complete search history.

(56) References Cited

U.S. PATENT DOCUMENTS

| | | | | | |
|---|---|---|---|---|---|
| 5,156,095 | A * | 10/1992 | Hansbaek | A47B 1/03 | 108/66 |
| 5,237,937 | A * | 8/1993 | Peltier | A47B 13/088 | 108/66 |
| 6,009,814 | A * | 1/2000 | Rossi | A47B 1/05 | 108/66 |
| 9,254,034 | B2 * | 2/2016 | Hsu | A47B 13/088 | |
| 2004/0194672 | A1 * | 10/2004 | Conley | A47B 1/02 | 108/83 |
| 2006/0075940 | A1 * | 4/2006 | Dodge | A47B 1/03 | 108/86 |
| 2006/0156963 | A1 * | 7/2006 | Fischer | A47B 1/05 | 108/69 |
| 2017/0127820 | A1 * | 5/2017 | Bortolato | A47B 1/05 | |

* cited by examiner

*Primary Examiner* — Daniel J Rohrhoff

(57) ABSTRACT

An expandable table which allows a user to easily increase the tabletop surface remotely. The expandable table includes a plurality of primary leaves, a plurality of secondary leaves, a motorized actuation disk, and a guide disk. The motorized actuation disk is concentrically and rotatably connected to the guide disk in order to delineate a travel path for each of the primary leaves and each of the secondary leaves. The primary leaves and the secondary leaves are radially distributed about and operatively coupled to the motorized actuation disk and the guide disk. In a retracted configuration, the primary leaves make up the tabletop surface. In an expanded configuration, the primary leaves and the secondary leaves are positioned offset to a rotation axis of the motorized actuation disk with the secondary leaves being interspersed between the primary leaves. Additionally. The centerpiece is raised in order to yield a substantially larger tabletop surface.

12 Claims, 9 Drawing Sheets

AUTOMATED EXPANDABLE TABLE

The current application claims a priority to the U.S. Provisional Patent application Ser. No. 62/350,535 filed on Jun. 15, 2016.

FIELD OF THE INVENTION

The present invention relates generally to table furniture. More specifically, the present invention is a self-expanding mechanical table. The present invention utilizes a plurality of enclosed planar leaves in order to expand the overall tabletop surface without manual labor.

BACKGROUND OF THE INVENTION

Dining room tables are the focus of any dining room area. The design of each dining room table is specific to user's stylistic preferences and the environment. One aspect of dining room tables that is adjustable and convertible is the size. Current dining room tables that are adjustable have pivoting table ends or removable leaves. Dining room tables with removable leaves are more versatile such that the size of the table is not limited to one additional configuration. Dining room tables that have motorized removable leaves require the use of multiple motors not only increasing the cost of the table but also requiring more electricity to power each motor.

The present invention simplifies the process of expanding and retracting a table with a single motor. Additionally, the present invention does not require the user to remove or add any additional leaves, thus streamlining the transformation process. The present invention utilizes a motor and a rotation plate in order to expand a plurality of planar leaves while simultaneously raising additional expansion leaves to fill in the created gaps, thus increasing and expanding the tabletop surface. This allows for the user to easily and quickly transform a table for six into a table for twelve. When the present invention is positioned into the retracted configuration, the additional expansion leaves and all the additional required hardware are conveniently concealed within the housing of the tabletop, thus requiring no additional storage.

DETAIL DESCRIPTIONS OF THE INVENTION

All illustrations of the drawings are for the purpose of describing selected versions of the present invention and are not intended to limit the scope of the present invention.

The present invention generally relates to alternative designs for furniture. More specifically, the present invention is an automated expandable table. The present invention allows a user to significantly increase the serving surface of a table without requiring the user to exert any manual labor. Additionally, the present invention maintains a round tabletop in either configuration. This ensures that all guests or individuals sitting are equally distributed about the tabletop for sharing food items and conversation purposes.

Figure 4:
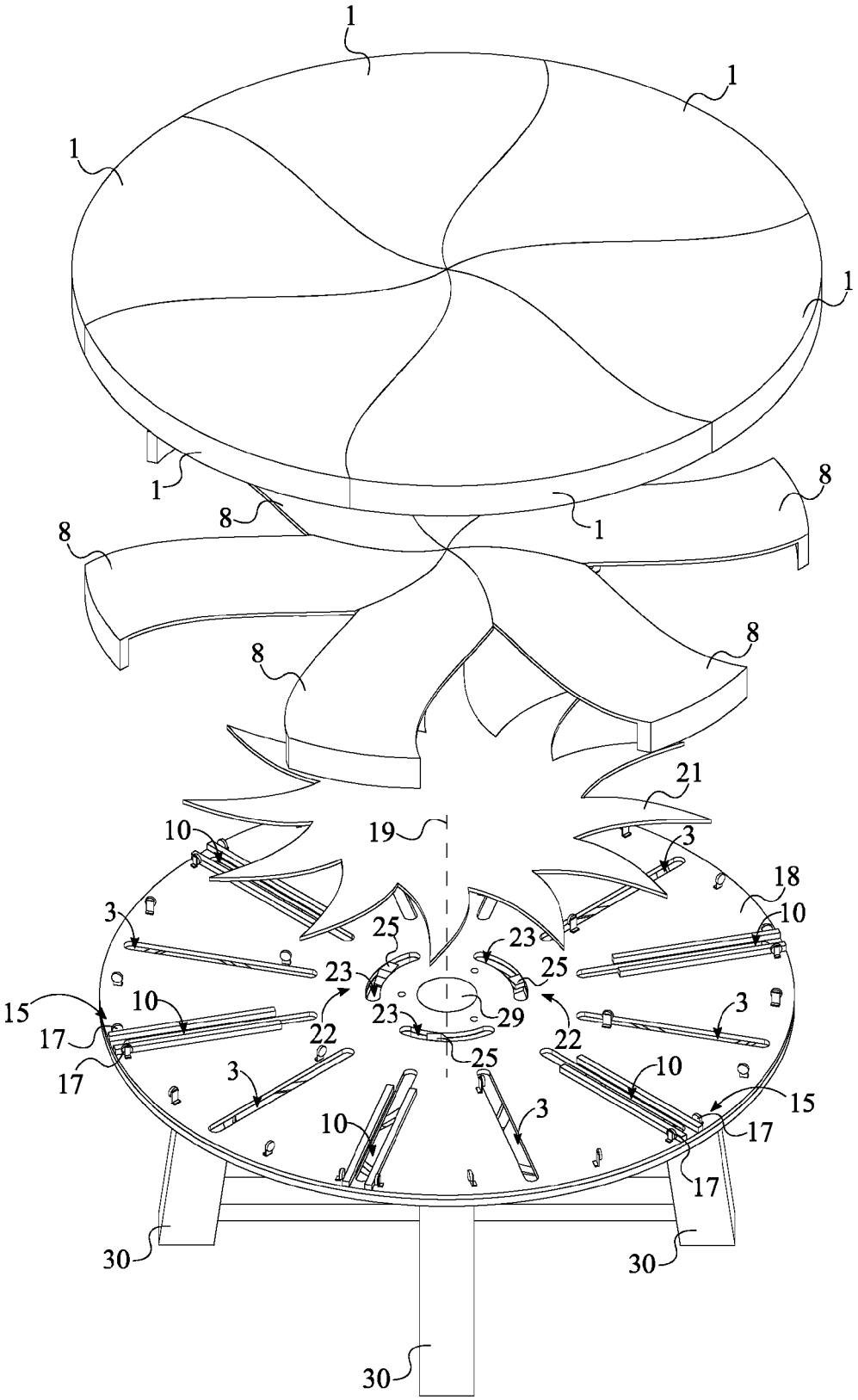
FIG. 4 is a partially exploded view of the present invention.
Figure 5:
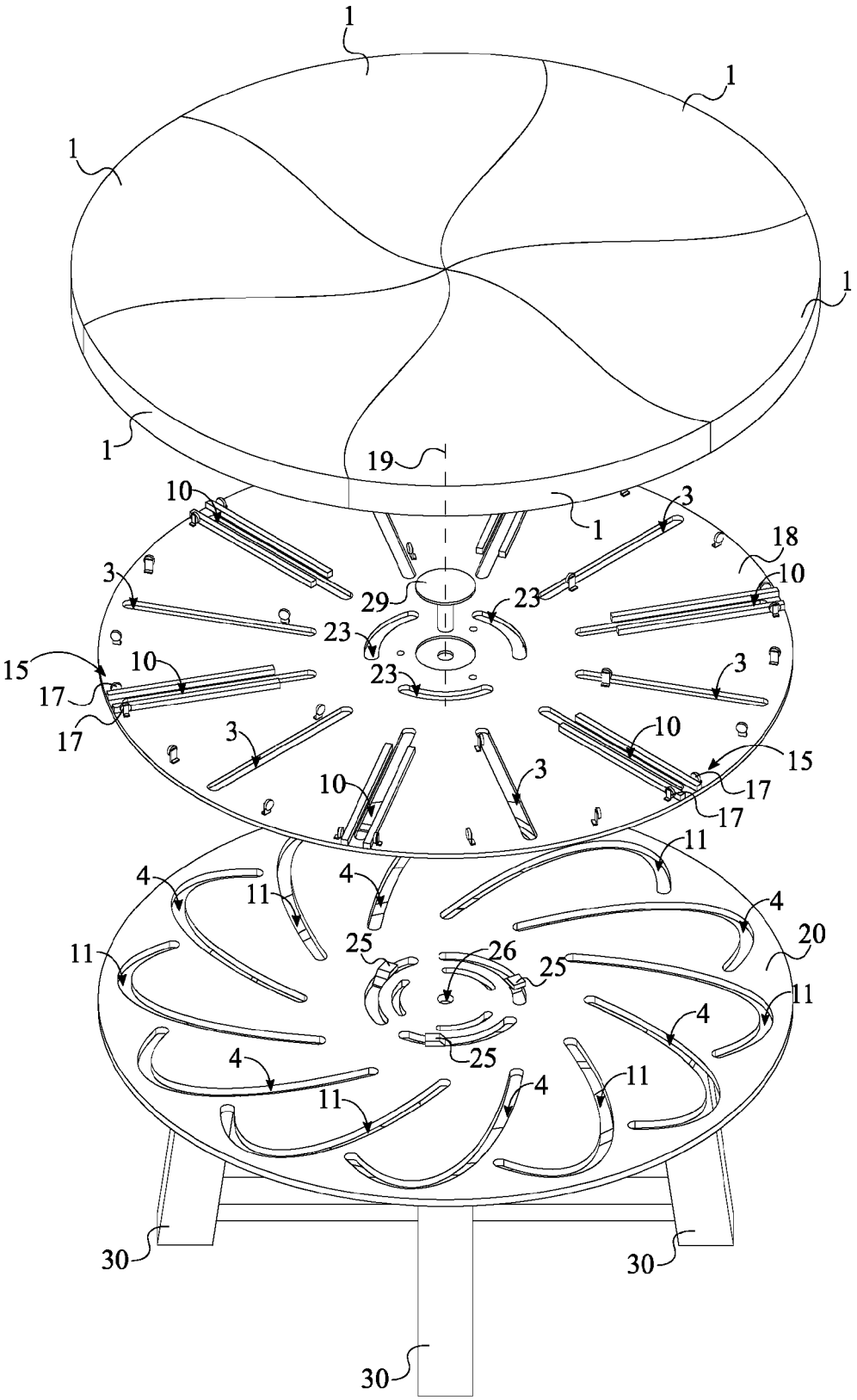
FIG. 5 is an alternative partially exploded view of the present invention.

Referring to FIG. 4 and FIG. 5, the present invention comprises a plurality of primary leaves 1, a plurality of secondary leaves 8, a centerpiece 21, a motorized actuation disk 18, a guide disk 20, an annular base plate 31, and a plurality of support legs 30. The motorized actuation disk 18 and the guide disk 20 support and control the translation of the plurality of primary leaves 1, the plurality of secondary leaves 8, and the centerpiece 21. In particular, the motorized actuation disk 18 and the guide disk 20 convert rotational motion into radial translation of the plurality of primary leaves 1 and the plurality of secondary leaves 8, as well as raise and lower the centerpiece 21. This configuration allows the present invention to be positioned into a retracted configuration and an expanded configuration. The motorized actuation disk 18 provides the rotational motion and is concentrically and rotatably mounted to the guide disk 20. The guide disk 20 provides a travel path for each of the plurality of primary leaves 1 and each of the plurality of secondary leaves 8.

The plurality of primary leaves 1, the plurality of secondary leaves 8, and the centerpiece 21 make up the tabletop layer of the present invention. The plurality of primary leaves 1 make up the majority of the tabletop surface of the present invention. The plurality of primary leaves 1 is radially distributed about a rotation axis 19 of the motorized actuation disk 18. Each of the plurality of primary leaves 1 is a planar structure that is semi-circular, sector-like, in shape such that in the retracted configuration a circular outline is formed, similar to traditional tables. Although alternative shapes may also be utilized including, but not limited to, oval. Additionally, the plurality of primary leaves 1 is positioned offset from the motorized actuation disk 18 in order to create a storage space/clearance for the centerpiece 21 and the plurality of secondary leaves 8 when the present invention is positioned into the retracted configuration. Each of the plurality of primary leaves 1 is operatively coupled to the guide disk 20 through the motorized actuation disk 18. As a result, the guide disk 20 directs radial-offsetting movement for each of the plurality of primary leaves 1 while the motorized actuation disk 18 drives the radial-offsetting movement for each of the plurality of primary leaves 1. Radial-offsetting movement is defined by linear translation of each of the plurality of primary leaves 1 towards and away from the rotation axis 19 of the motorized actuation disk 18.

The plurality of secondary leaves 8 provides additional tabletop surface when the present invention is positioned into the expanded configuration. Referring to FIG. 4, the plurality of secondary leaves 8 is radially distributed about the rotation axis 19 of the motorized actuation disk 18. Each of the secondary leaves is a planar body sized to fit in between two adjacent primary leaves from the plurality of primary leaves 1. Thus, each of the plurality of secondary leaves 8 is an elongated plank with the sides curved to compliment the curvature of each of the plurality of primary leaves 1. The number within the plurality of secondary leaves 8 matches the number within the plurality of primary leaves 1 in order to yield a flush and symmetrical tabletop surface when the present invention is positioned into the expanded configuration. In order to transition between the retracted configuration and the expanded configuration, each of the plurality of secondary leaves 8 is operatively coupled to the guide disk 20 through the motorized actuation disk 18. Thus, the guide disk 20 directs radial-offsetting movement and elevational movement for each of the plurality of secondary leaves 8 while the motorized actuation disk 18 drives the radial-offsetting and elevational movement for each of the plurality of secondary leaves 8. Radial-offsetting movement and elevational movement is defined by linear translation of each of the plurality of secondary leaves 8 towards and away from the rotation axis 19 of the motorized actuation disk 18; and, the vertical translation of each of the plurality of secondary leaves 8 towards and away from the motorized actuation disk 18. This allows the plurality of secondary leaves 8 to be retracted under the plurality of primary leaves 1 as seen in FIG. 4.

When the plurality of the primary leaves and the plurality of secondary leaves 8 are retracted, an empty space is formed in the center. The centerpiece 21 covers the empty space in order to complete the tabletop surface when the present invention is positioned into the expanded configuration. The centerpiece 21 is stored underneath the plurality of primary leaves 1 and the plurality of secondary leaves 8. In the preferred embodiment of the present invention, the centerpiece 21 is a planar body that is gear-shaped. The centerpiece 21 fills in the central gap of the tabletop surface of the present invention and interlocks with each of the plurality of primary leaves 1 and each of the plurality of secondary leaves 8 in order to yield a flush surface. As such, the centerpiece 21, each of the plurality of primary leaves 1, and each of the plurality of secondary leaves 8 are designed to compliment and interlock with each other similar to a jigsaw puzzle. In order to raise and lower, the centerpiece 21 is operatively coupled to the guide disk 20 through the motorized actuation disk 18. As a result, the guide disk 20 directs elevational movement of the centerpiece 21. The motorized actuation disk 18 is used to drive the elevational movement for the centerpiece 21. Elevational movement is defined by the vertical translation of the centerpiece 21 away and towards the motorized actuation disk 18. A plurality of support brackets may also be radially distributed about the centerpiece 21 that interacts with the tapered end of each of the plurality of secondary leaves 8 to provide additional vertical support and rigidity.

Figure 2:
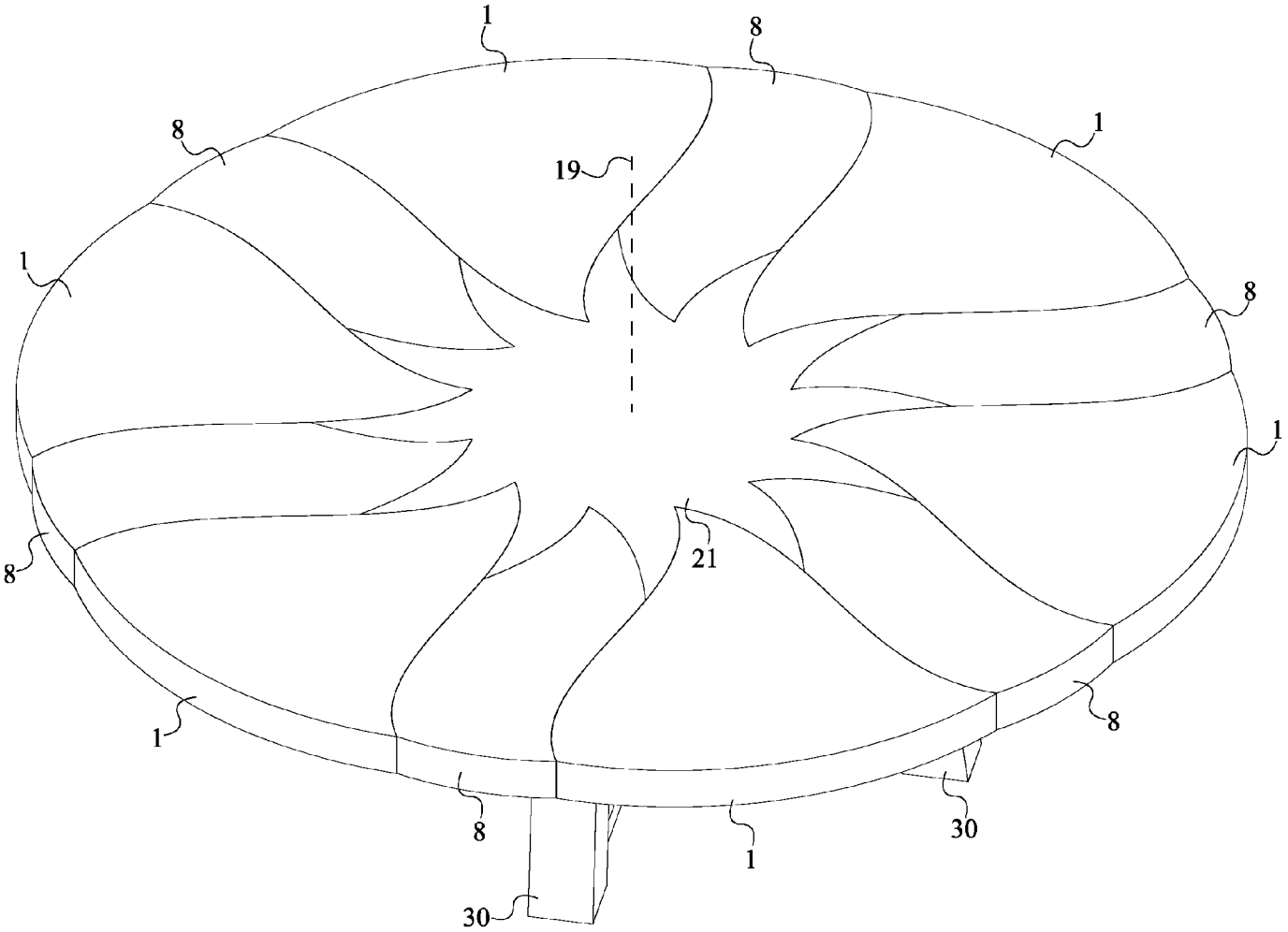
FIG. 2 is a perspective view of the present invention in an expanded configuration.

FIG. 2 depicts the present invention in the expanded configuration. The expanded configuration includes the plurality of primary leaves 1, the plurality of secondary leaves 8, and the centerpiece 21 positioned to yield a single, flush tabletop surface. In the expanded configuration, each of the plurality of primary leaves 1 is positioned radially offset to the rotation axis 19 of the motorized actuation disk 18. Similarly, each of the plurality of secondary leaves 8 is positioned radially offset to the rotation axis 19 of the motorized actuation disk 18. As a result, the plurality of secondary leaves 8 is positioned interspersed through the plurality of primary leaves 1. This creates an annular tabletop surface. To fill the gap, the centerpiece 21 is raised and positioned adjacent to the plurality of primary leaves 1 and the plurality of secondary leaves 8. Resultantly, each of the plurality secondary leaves, the centerpiece 21, and each of the plurality of primary leaves 1 are positioned coplanar with each other. In order to ensure a non-breaking surface, the centerpiece 21 is perimetrically coincident with the plurality of primary leaves 1 and the plurality of secondary leaves 8. Furthermore, in the preferred embodiment, the present invention further comprises a plurality of tongue-and-groove mechanism. Each plurality of tongue-and-groove mechanism is mechanically integrated into the junctions in between the plurality of primary leaves 1, the plurality of secondary leaves 8, and the centerpiece 21. As a result, a substantially rigid tabletop is created.

Figure 1:
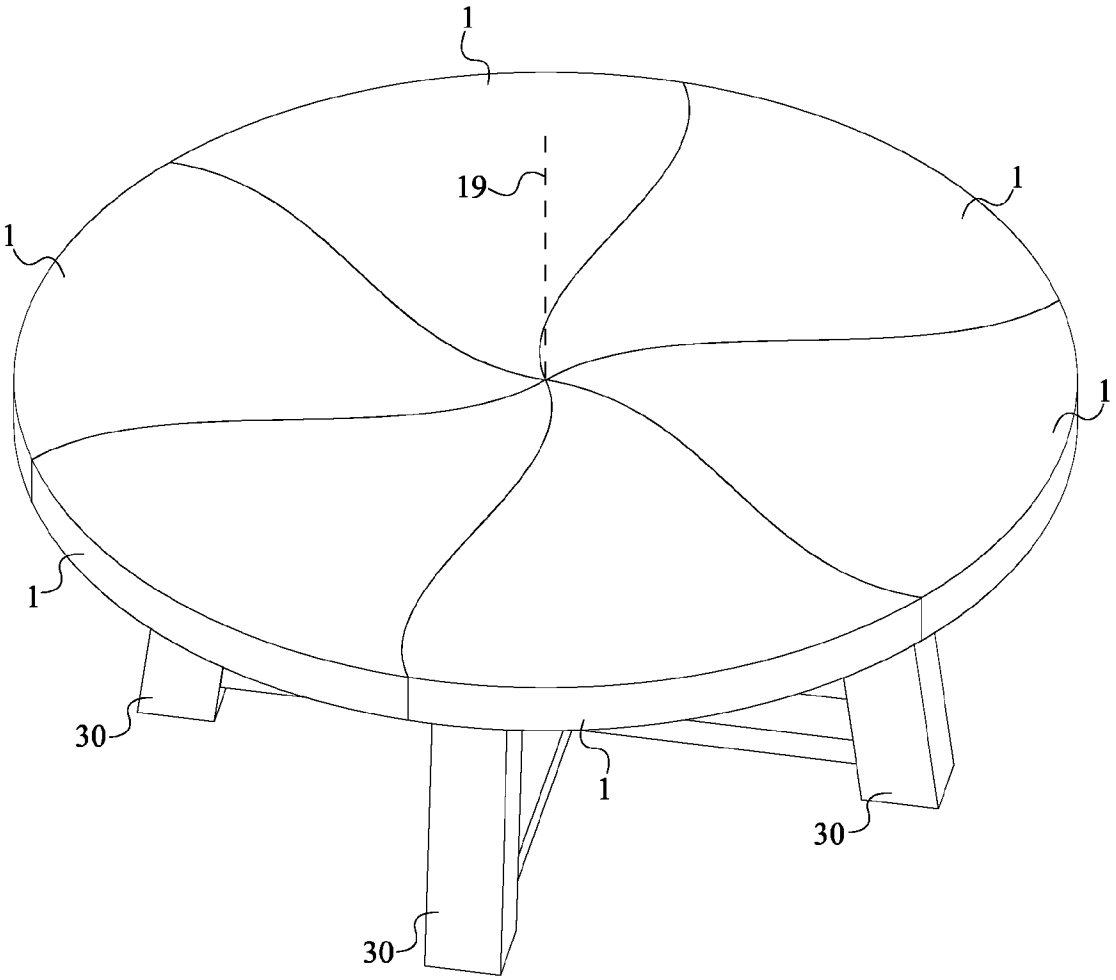
FIG. 1 is a perspective view of the present invention in a retracted configuration.

FIG. 1 depicts the present invention in the retracted configuration. The retracted configuration includes the plurality of primary leaves 1, the plurality of secondary leaves 8, and the centerpiece 21 being retracted towards the rotation axis 19 of the motorized actuation disk 18 in order to yield a relatively smaller tabletop surface. In this configuration, the plurality of secondary leaves 8 is radially pressed against each other in order to create a closed off storage space underneath. The plurality of secondary leaves 8 and the centerpiece 21 are positioned in between the plurality of primary leaves 1 and the motorized actuation disk 18. This configuration hides the plurality of secondary leaves 8 and the centerpiece 21 in between the plurality of primary leaves 1 and the motorized actuation disk 18. In the preferred embodiment of the present invention, the motorized actuation disk 18 only need to turn 90 degrees in order to switch the present invention from the retracted configuration to the expanded configuration and vice versa.

The plurality of support legs 30 and the annular base plate 31 act as the support structure for the present invention. The annular base plate 31 mounts the plurality of support legs 30 to the guide disk 20. In particular, the annular base plate 31 is positioned concentric and adjacent to the guide disk 20, opposite the motorized actuation disk 18. Additionally, the annular base plate 31 is mounted offset to the guide disk 20 in order to provide clearance space for protruding components traversing through the guide disk 20. The plurality of support legs 30 vertically support the present invention and is positioned adjacent to the annular base plate 31, opposite the guide disk 20. The plurality of support legs 30 is radially distributed about the rotation axis 19 of the motorized actuation disk 18 for symmetrical support. Each of the plurality of support legs 30 is adjacently connected to the annular base plate 31. The material composition, size, shape, length, width, and height of each of the plurality of support legs 30 is subject to change based on the needs and preferences of the user.

Figure 3:
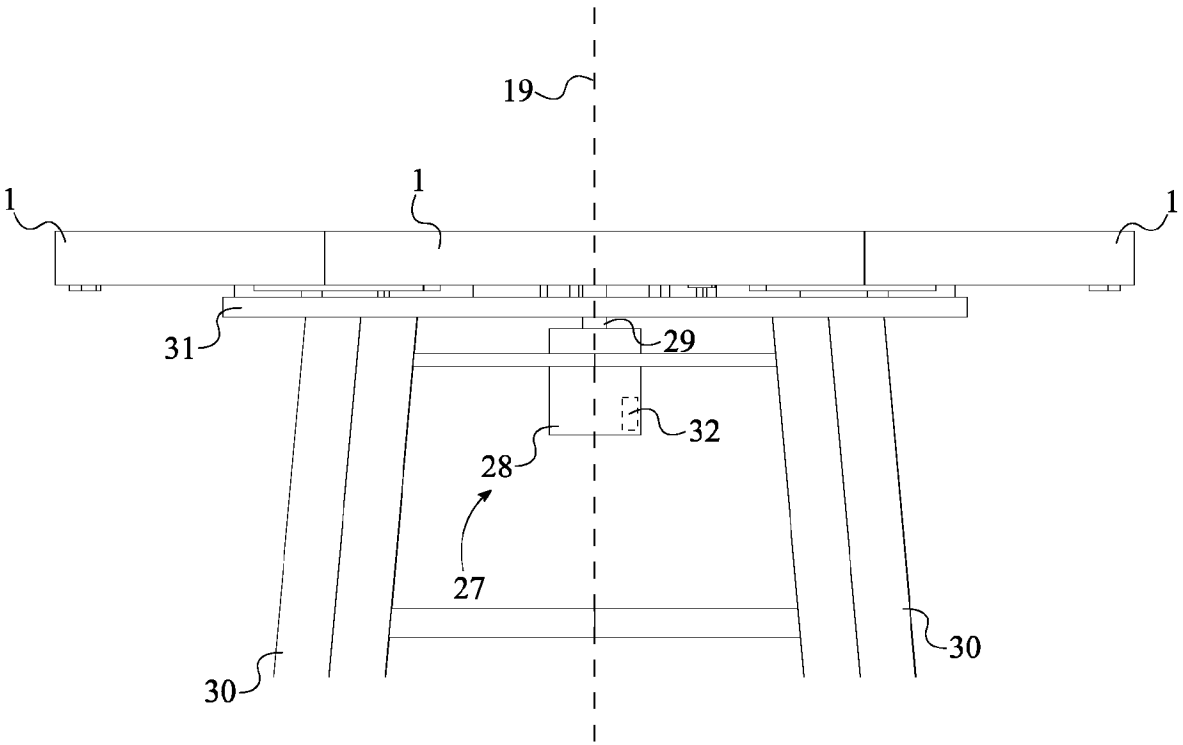
FIG. 3 is a side-view of the present invention.
Figure 9:
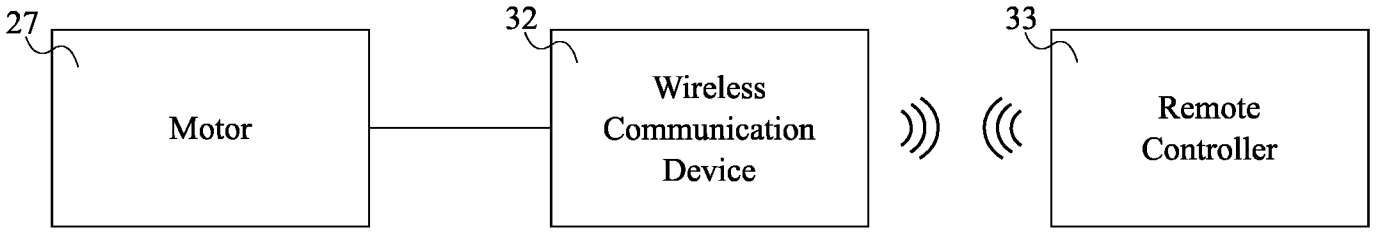
FIG. 9 is an electronic schematic of the present invention.

The motorized actuation disk 18 is a planar disk that is able to rotate about the rotation axis 19 of the motorized actuation disk 18 through the aid of a machine. Referring to FIG. 3 and FIG. 4, the present invention further comprises a motor 27 and a first hole 26. The motor 27 converts electrical energy into rotational motion in order to apply a torque on to the motorized actuation disk 18. The motor 27 comprises a stator 28 and a rotor 29. Stator 28 receives electric energy and outputs the rotational motion through the rotor 29. The first hole 26 is positioned concentric with the guide disk 20 and traverses through the guide disk 20. The first hole 26 is sized to receive the rotor 29. The stator 28 of the motor 27 is mounted adjacent to the guide disk 20, opposite the planar body. The rotor 29 of the motor 27 is positioned within the first hole 26 and is terminally and concentrically connected to the motorized actuation disk 18. A variety of means may be used to control the motor 27 including, but not limited to, a switch, a program, a control box, and other similar means. A variety of means may be used to transfer torque force onto the motorized actuation disk 18 including, but not limited to, a gear box, a drive belt, and a direct link. In the preferred embodiment, the present invention further comprises a wireless communication device 32 and a remote controller 33. The wireless communication device 32 is mounted adjacent to the motor 27 as seen in FIG. 3. Additionally, the wireless communication device 32 is electronically connected to the motor 27. Referring to FIG. 9, the wireless communication device 32 is communicably coupled to the remote controller 33 in order to allow the user to wirelessly control the configuration of the present invention. With a simple click of a button on the remote controller 33 the user can transform the present invention from the retracted configuration into the expanded configuration and vice versa. In alternative embodiments, the present invention may also utilize an actuation button to control the motor 27, a microcontroller to control the motor 27, or may be compatible with an external computing device in order to control the motor 27.

Figure 6:
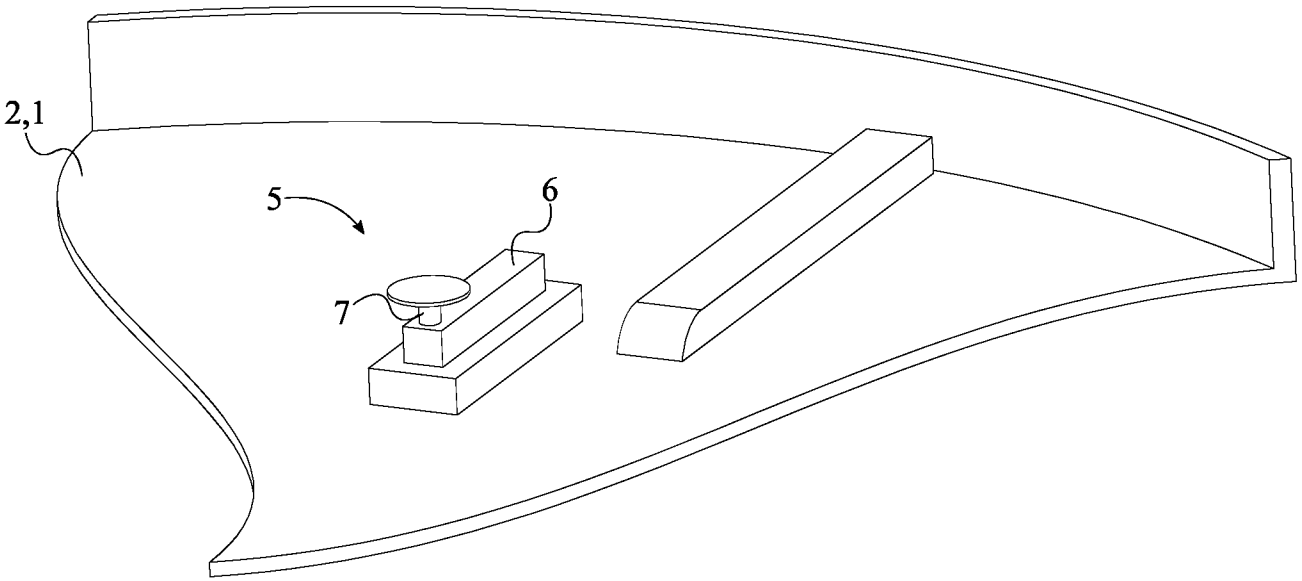
FIG. 6 is a bottom perspective view of a specific primary leaf from the plurality of primary leaves.

Referring to FIG. 5 and FIG. 6, the operative coupling between each of the plurality of primary leaves 1 and the guide disk 20 through the motorized actuation disk 18 comprises a specific primary leaf 2 from the plurality of primary leaves 1, a first radial slot 3, a first J-shaped slot 4, and a first sliding linkage 5. The first radial slot 3 provides a linear path for the specific primary leaf 2 to follow. The linear path extends a straight line from the rotation axis 19 of the motorized actuation disk 18 to the rim of the motorized actuation disk 18. In particular, the first radial slot 3 traverses through the motorized actuation disk 18. It is preferred that the first radial slot is positioned offset from the rotational axis of the motorized actuation disk 18 in order to allow the motorized actuation disk 18 to be manufactured from a single piece of material.

The first J-shaped slot 4 is positioned adjacent to the first radial slot 3 and traverses through the motorized actuation disk 18. A straight portion of the first J-shaped slot 4 is positioned offset to the rotation axis 19 of the motorized actuation disk 18, similar to the first radial slot 3. A curved portion of the first J-shaped slot 4 is positioned adjacent to the rim of the motorized actuation disk 18 as seen in FIG. 5. More specifically, the first J-shaped slot 4 is positioned such that the first J-shaped slot 4 and the first radial slot 3 intersect/cross each other as the motorized actuation disk 18 rotates. The first sliding linkage 5 couples the specific primary leaf 2 to the first radial slot 3 and the first J-shaped slot 4. The first sliding linkage 5 is positioned in between the specific primary leaf 2 and the motorized actuation disk 18. In particular, the first sliding linkage 5 is connected to the specific primary leaf 2, preferably perpendicularly extending away from the specific primary leaf 2. Additionally, the first sliding linkage 5 is positioned adjacent to a tapered end of the specific primary leaf 2. The first sliding linkage 5 is slidably engaged to the first radial slot 3 and the first J-shaped slot 4 in order to allow the specific primary leaf 2 to translate relative to the motorized actuation disk 18 and the guide disk 20. In one embodiment, a sliding bracket is used to reduce the amount of friction between the specific primary leaf 2 and the motorized actuation disk 18. In particular, the sliding bracket is radially connected in between the specific primary leaf 2 and the motorized actuation disk 18, adjacent to the first radial slot 3.

Resultantly, the radial location of the specific primary leaf 2 is defined by the intersecting point between the first radial slot 3 and the first J-shaped slot 4. The intersecting point between the first radial slot 3 and the first J-shaped slot 4 varies as the motorized actuation disk 18 is rotated relative to the guide disk 20. In general, as the motorized actuation disk 18 rotates, the intersecting point moves radially inwards and radially outwards. Simultaneously, the first sliding linkage 5 and, thus, the specific primary leaf 2 move according to the travel path of the intersecting point; i.e. radially inwards and radially outwards relative to the rotation axis 19 of the motorized actuation disk 18. This design is identical for each of the plurality of primary leaves 1. As a result, when the motorized actuation disk 18 rotates, each of the plurality of primary leaves 1 move the same distance together, radially inward or radially outward.

Referring to FIG. 6, in the preferred embodiment of the present invention, the first sliding linkage 5 comprises a first sliding block 6 and a first roller 7. The first sliding block 6 is a rectangular extrusion sized and shaped complimentary to the width of the first radial slot 3 and the thickness of the motorized actuation disk 18. The first sliding block 6 is adjacently connected to the specific primary leaf 2 and engages the first radial slot 3. In particular, the first sliding block 6 is slidably positioned within the first radial slot 3, free to slide towards and away from the rotation axis 19 of the motorized actuation disk 18. A rectangular extrusion is used as the first sliding block 6 to steady the specific primary leaf 2 and ensure that the specific primary leaf 2 does not rotate relative to the motorized actuation disk 18. The first roller 7 is connected normal to the first sliding block 6, opposite the specific primary leaf 2 in order to engage the first J-shaped slot 4. The first roller 7 is a cylindrical extrusion that is capable of independent rotary motion about an axis normal to the first sliding block 6. The first roller 7 is movably engaged within the first J-shaped slot 4. The first roller 7 is used for the first J-shaped slot 4 because the motorized actuation disk 18 rotates relative to the guide disk 20 and as such the first roller 7 will apply a lateral force onto the guide disk 20, within the first J-shaped slot 4. This forces the first roller 7 to engage the lateral sides of the first J-shaped slot 4, rotate, and follow the path set by the first J-shaped slot 4.

Figure 7:
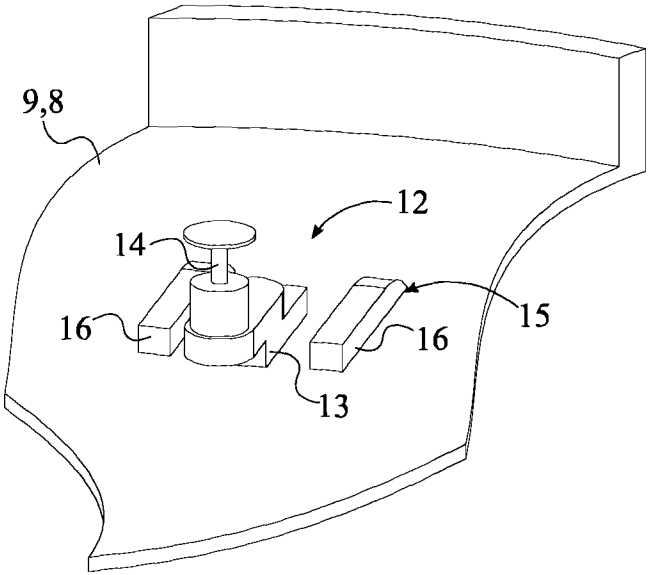
FIG. 7 is a bottom perspective view of a specific secondary leaf from the plurality of secondary leaves.

Referring to FIG. 5 and FIG. 7, the operative coupling between each of the plurality of secondary leaves 8 and the guide disk 20 through the motorized actuation disk 18 comprises a specific secondary leaf 9 from the plurality of secondary leaves 8, a second radial slot 10, a second J-shaped slot 11, a second sliding linkage 12, and a first lifting mechanism 15. The second radial slot 10 and the second J-shaped slot 11 are identical to the first radial slot 3 and the first J-shaped slot 4. This ensures that the plurality of secondary leaves 8 and the plurality of primary leaves 1 move simultaneous. Although, in addition to the radial movement, each of the plurality of secondary leaves 8 also vertically translates relative to the motorized actuation disk 18. The second radial slot 10 provides a linear path for the secondary primary leaf to follow. The linear path extends a straight line from the rotation axis 19 of the motorized actuation disk 18 to the rim of the motorized actuation disk 18. In particular, the second radial slot 10 traverses through the motorized actuation disk 18. It is preferred that the second radial slot 10 is positioned offset from the rotational axis of the motorized actuation disk 18 in order to allow the motorized actuation disk 18 to be manufactured from a single piece of material.

The second J-shaped slot 11 is positioned adjacent to the second radial slot 10 and traverses through the motorized actuation disk 18. A straight portion of the second J-shaped slot 11 is positioned offset to the rotation axis 19 of the motorized actuation disk 18, similar to the second radial slot 10. A curved portion of the second J-shaped slot 11 is positioned adjacent to the rim of the motorized actuation disk 18 as seen in FIG. 5. More specifically, the second J-shaped slot 11 is positioned such that the second J-shaped slot 11 and the second radial slot 10 intersect/cross each other as the motorized actuation disk 18 rotates. The second sliding linkage 12 couples the specific secondary leaf 9 to the second radial slot 10 and the second J-shaped slot 11. The second sliding linkage 12 is positioned in between the specific secondary leaf 9 and the motorized actuation disk 18. In particular, the second sliding linkage 12 is connected to the specific secondary leaf 9, preferably perpendicularly extending away from the specific secondary leaf 9. Additionally, the second sliding linkage 12 is positioned adjacent to a tapered end of the specific secondary leaf 9. The second sliding linkage 12 is slidably engaged to the second radial slot 10 and the second J-shaped slot 11 in order to allow the specific secondary leaf 9 to translate relative to the motorized actuation disk 18 and the guide disk 20.

Resultantly, the radial location of the specific secondary leaf 9 is defined by the intersecting point between the second radial slot 10 and the second J-shaped slot 11. The intersecting point between the second radial slot 10 and the second J-shaped slot 11 varies as the motorized actuation disk 18 is rotated relative to the guide disk 20. In general, as the motorized actuation disk 18 rotates, the intersecting point moves radially inwards and radially outwards. Simultaneously, the second sliding linkage 12 and, thus, the specific secondary leaf 9 move according to the travel path of the intersecting point; i.e. radially inwards and radially outwards relative to the rotation axis 19 of the motorized actuation disk 18. This design is identical for each of the plurality of secondary leaves 8. As a result, when the motorized actuation disk 18 rotates, each of the plurality of secondary leaves 8 move the same distance together, radially inward or radially outward.

The radial travel path for each of the plurality of secondary leaves 8 is identical to the radial travel path for each of the plurality of the secondary leaves. In addition to radial translation, each of the plurality of secondary leaves 8 also raises and lowers relative to the motorized actuation disk 18 through the first lifting mechanism 15. In particular, the first lifting mechanism 15 is operatively integrated in between the motorized actuation disk 18 and the specific secondary leaf 9, wherein the first lifting mechanism 15 is used to raise and lower the specific secondary leaf 9 relative to the motorized actuation disk 18. More specifically, when the specific secondary leaf 9 is positioned adjacent to the rotation axis 19 of the motorized actuation disk 18, the first lifting mechanism 15 is not engaged and the specific secondary leaf 9 is positioned adjacent to the motorized actuation disk 18. When the specific secondary leaf 9 reaches a specific distance away from the rotation axis 19 of the motorized actuation disk 18, the first lifting mechanism 15 engages and raises the specific secondary leaf 9 away from the motorized actuation disk 18. This motion raises each of the plurality of secondary leaves 8 from a storage state into a functional state, thus increasing the overall tabletop surface of the present invention.

Referring to FIG. 7, in the preferred embodiment of the present invention, the second sliding linkage 12 comprises a second sliding block 13 and a second roller 14. The second sliding block 13 is a rectangular extrusion sized and shaped complimentary to the width of the second radial slot 10 and greater than the thickness of the motorized actuation disk 18. The additional height of the second sliding block 13 is designed to keep the second sliding linkage 12 engaged to the second radial slot 10 as the specific secondary leaf 9 raises away from the motorized actuation disk 18. The second sliding block 13 is adjacently connected to the specific secondary leaf 9 and engages the second radial slot 10. In particular, the second sliding block 13 is slidably positioned within the second radial slot 10, free to slide towards and away from the rotation axis 19 of the motorized actuation disk 18. A rectangular extrusion is used as the second sliding block 13 to steady the specific secondary leaf 9 and ensure that the specific secondary leaf 9 does not rotate relative to the motorized actuation disk 18. The second roller 14 is connected normal to the second sliding block 13, opposite the specific secondary leaf 9 in order to engage the second J-shaped slot 11. The second roller 14 is a cylindrical extrusion that is capable of independent rotary motion about an axis normal to the second sliding block 13. The length of the second roller 14 is greater than the thickness of the guide disk 20 in order to ensure the second sliding linkage 12 stays engaged to the second J-shaped slot 11 when the specific secondary leaf 9 is raised away from the motorized actuation disk 18. The second roller 14 is movably engaged within the second J-shaped slot 11. The second roller 14 is used for the second J-shaped slot 11 because the motorized actuation disk 18 rotates relative to the guide disk 20 and as such the second roller 14 will apply a lateral force onto the guide disk 20, within the second J-shaped slot 11. This forces the second roller 14 to engage the lateral sides of the second J-shaped slot 11, rotate, and follow the path set by the second J-shaped slot 11.

Referring to FIG. 5 and FIG. 7, the first lifting mechanism 15 comprises a pair of guide ramps 16 and a pair of guide wheels 17. In order to conceal the internal workings of the present invention, the pair of guide ramps 16 and the pair of guide wheels 17 are positioned in between the specific secondary leaf 9 and the motorized actuation disk 18. The pair of guide wheels 17 in conjunction with the pair of guide ramps 16 allow the specific secondary leaf 9 to smoothly raise and lower relative to the motorized actuation disk 18. Each of the pair of guide wheels 17 is a simple bearing wheel that is rotatably mounted to the motorized actuation disk 18. Additionally, the pair of guide wheels 17 is peripherally positioned on the motorized actuation disk 18, thus engaging the first lifting mechanism 15 only when the specific secondary leaf 9 reaches a specific distance away from the rotation axis 19 of the motorized actuation disk 18. The pair of guide ramps 16 are each a rectangular extrusion with a chamfered end. Each of the pair of guide ramps 16 is adjacently and radially connected to the specific secondary leaf 9. In particular, the pair ramps are oriented away from the rotation axis 19 of the motorized actuation disk 18 and are positioned adjacent to the second sliding linkage 12, away from the rotation axis 19 of the motorized actuation disk 18. This positions the second radial slot 10 in between the pair of guide wheels 17 and ensures that when the pair of guide ramps 16 press against the pair of guide wheels 17 that the specific secondary leaf 9 symmetrically raises and lowers. The pair of guide ramps 16 are aligned with the pair guide wheels to ensure that pair of guide ramps 16 press against and raise upwards onto the pair of guide wheels 17. When the specific secondary leaf 9 radially translates away from the rotation axis 19 of the motorized actuation disk 18, the pair of guide ramps 16 ride up the pair of guide wheels 17 and resultantly elevate the specific secondary leaf 9. This positioned the specific secondary leaf 9 coplanar with each of the plurality of primary leaves 1.

Figure 8:
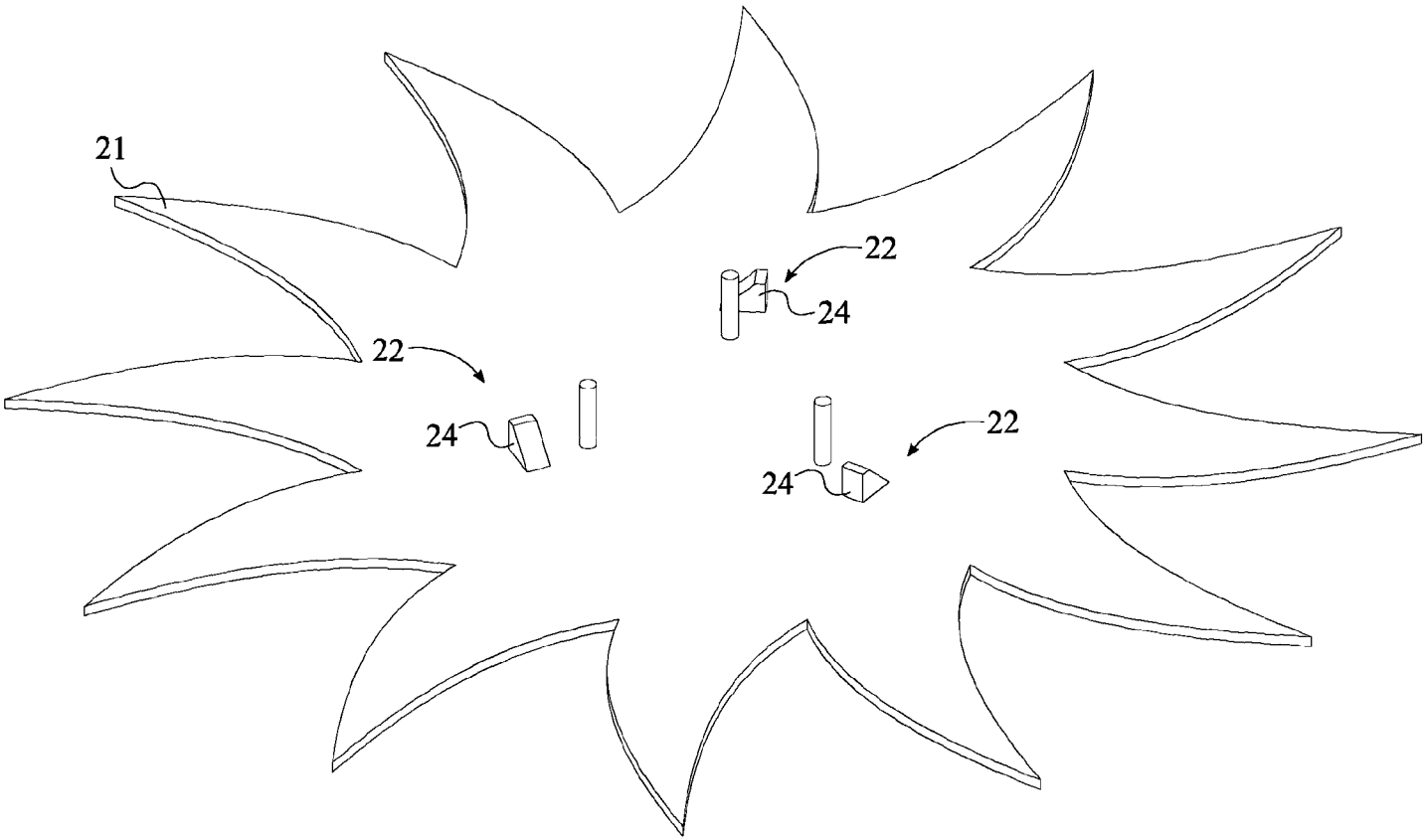
FIG. 8 is a bottom perspective view of the centerpiece component, partially depicting the plurality of second lifting mechanisms.

Referring to FIG. 4 and FIG. 8, the operative coupling between the centerpiece 21 and the guide disk 20 through the motorized actuation disk 18 comprises a plurality of second lifting mechanisms 22. Each of the plurality of second lifting mechanisms 22 is a ramp system which, when engaged, raises the centerpiece 21 away from the motorized actuation disk 18. For this function, the centerpiece 21 is slidably mounted to the motorized actuation disk 18 along the rotation axis 19 of the motorized actuation disk 18. In general, the centerpiece 21 is free to move towards and away from the motorized actuation disk 18 while simultaneously being rotatably coupled to the motorized actuation disk 18. The plurality of second lifting mechanisms 22 is radially distributed about the rotation axis 19 of the motorized actuation disk 18 in order to symmetrically raise the centerpiece 21. Additionally, the plurality of second lifting mechanisms 22 is positioned in between the centerpiece 21 and the guide disk 20. Each of the plurality of second lifting mechanisms 22 comprises a semicircular slot 23, a first ramp 24, and a second ramp 25. The semicircular slot 23 traverses through the motorized actuation disk 18 and is positioned adjacent to the rotation axis 19 of the motorized actuation disk 18. The first ramp 24 and the second ramp 25 are each a rectangular extrusion with a chamfered end. The first ramp 24 is adjacently connected to the centerpiece 21 while the second ramp 25 is adjacently connected to the guide disk 20. Additionally, the first ramp 24 is aligned along the semicircular slot 23 and the second ramp 25 is positioned within the semicircular slot 23. This ensures that when the motorized actuation disk 18 rotates, the first ramp 24 will press against the second ramp 25 and thus raise the centerpiece 21. When the first ramp 24 is not engaged with the second ramp 25, the centerpiece 21 is pressed against the motorized actuation disk 18 with the first ramp 24 being positioned within the semicircular slot 23. The orientation and the configuration of the first ramp 24 and the second ramp 25 are designed to raise the centerpiece 21 simultaneously as the plurality of primary leaves 1 and the plurality of secondary leaves 8 move radially outwards away. In the preferred embodiment, a complimentary semicircular slot aligned with the semicircular slot 23 traverses through the guide disk 20. The complimentary semicircular receives the first ramp 24 when the second ramp 25 and the first ramp 24 are not engaged. This allows the centerpiece 21 to sit directly against the motorized actuation disk 18 when the present invention is positioned into the retracted configuration.

The centerpiece 21 is slidably mounted to the motorized actuation disk 18 through a plurality of pins. The plurality of pins is radially distributed about the rotation axis 19 of the motorized actuation disk 18 and each of the plurality pins is normally connected to the centerpiece 21. Corresponding to each of the plurality of pins is a hole in the motorized actuation disk 18 and a semicircular slot 23 in the guide disk 20. Each of the plurality of pins are slidably engaged within the corresponding hole and semicircular slot 23. This design ensures that the centerpiece 21 rotates with the motorized actuation disk 18 but allows the centerpiece 21 to raise and lower without decoupling with the motorized actuation disk 18.

It is preferred that the thickness of each of the plurality of primary leaves 1, each of the plurality of secondary leaves 8, the centerpiece 21, the guide disk 20, and the motorized actuation disk 18 is designed such that the total vertical thickness is four inches. This traditional tabletop surface is thirty inches from the ground. With the tabletop of the present invention taking up four inches, that leaves twenty-six inches remaining, ideal for guests and individuals as traditional chairs are of a height between seventeen and eighteen inches. Additionally, because of the small profile of the present invention, a variety of bases and support structures may be used.

Although the invention has been explained in relation to its preferred embodiment, it is to be understood that many other possible modifications and variations can be made without departing from the spirit and scope of the invention as hereinafter claimed.

What is claimed is:

1. An automated expandable table comprises:
- a centerpiece;
- a plurality of primary leaves;
- a plurality of secondary leaves;
- a motorized actuation disk;
- a guide disk;
- the motorized actuation disk being concentrically and rotatably mounted to the guide disk;
- the plurality of primary leaves being radially distributed about a rotation axis of the motorized actuation disk;
- the plurality of secondary leaves being radially distributed about the rotation axis of the motorized actuation disk;
- each of the plurality of primary leaves being operatively coupled to the guide disk through the motorized actuation disk, wherein the guide disk is used to direct radial-offsetting movement for each of the plurality of primary leaves, and wherein the motorized actuation disk is used to drive the radial-offsetting movement for each of the plurality of primary leaves;
- each of the plurality of secondary leaves being operatively coupled to the guide disk through the motorized actuation disk, wherein the guide disk is used to direct radial-offsetting and elevational movement for each of the plurality of secondary leaves, and wherein the motorized actuation disk is used to drive the radial-offsetting and elevational movement for each of the plurality of secondary leaves; and
- the centerpiece being operatively coupled to the guide disk through the motorized actuation disk, wherein the guide disk is used to direct elevational movement of the centerpiece, and wherein the motorized actuation disk is used to drive the elevational movement for the centerpiece.

2. The automated expandable table as claimed in claim 1 comprises:
- a first hole;
- a motor;
- the first hole being positioned concentric with the guide disk;
- the first hole traversing through the guide disk;
- a stator of the motor being mounted adjacent to the guide disk, opposite the motorized actuation disk;
- a rotor of the motor being positioned within the first hole; and
- the motorized actuation disk being concentrically and terminally connected to the rotor.

3. The automated expandable table as claimed in claim 2 comprises:
- a wireless communication device;
- a remote controller;
- the wireless communication device being mounted adjacent to the motor;
- the wireless communication device being electronically connected to the motor; and
- the remote controller being communicably coupled to the wireless communication device.

4. The automated expandable table as claimed in claim 1 comprises:
- a plurality of support legs;
- an annular base plate;
- the annular base plate being positioned concentric and adjacent to the guide disk, opposite the motorized actuation disk;

the annular base plate being mounted offset to the guide disk;

the plurality of support legs being positioned adjacent to annular base plate, opposite to the guide disk;

the plurality of support legs being radially distributed about the rotation axis of the motorized actuation disk; and each of the plurality of support legs being adjacently connected to the annular base plate.

5. The automated expandable table as claimed in claim 1 comprises:

the operative coupling between each of the plurality of primary leaves and the guide disk through the motorized actuation disk comprises a specific primary leaf from the plurality of primary leaves, a first radial slot, a first J-shaped slot, and a first sliding linkage;

the plurality of primary leaves being positioned offset from the motorized actuation disk;

the first radial slot traversing through the motorized actuation disk;

the first J-shaped slot traversing through the guide disk;

the first radial slot and the first J-shaped slot being positioned adjacent to each other;

the first sliding linkage being positioned in between the specific primary leaf and the motorized actuation disk the first sliding linkage being connected to the specific primary leaf; and the first sliding linkage being slidably engaged to the first radial slot and the first J-shaped slot.

6. The automated expandable table as claimed in claim 5 comprises:

the first sliding linkage comprises a first sliding block and a first roller;

the first sliding block being adjacently connected to the specific primary leaf;

the first roller being connected normal to the first sliding block, opposite the specific primary leaf;

the first sliding block being slidably positioned within the first radial slot; and the first roller being movably engaged within the first J-shaped slot.

7. The automated expandable table as claimed in claim 1 comprises:

the operative coupling between each of the plurality of secondary leaves and the guide disk through the motorized actuation disk comprises a specific secondary leaf, a second radial slot, a second J-shaped slot, a second sliding linkage, and a first lifting mechanism;

the second radial slot traversing through the motorized actuation disk;

the second J-shaped slot traversing through the guide disk;

the second radial slot and the second J-shaped slot being positioned adjacent to each other;

the second sliding linkage being positioned in between the motorized actuation disk and the specific secondary leaf;

the second sliding linkage being connected adjacent to the specific secondary leaf;

the second sliding linkage being slidably engaged to the second radial slot and the second J-shaped slot; and the first lifting mechanism being operatively integrated in between the motorized actuation disk and the specific secondary leaf, wherein the first lifting mechanism is used to raise and lower the specific secondary leaf relative to the motorized actuation disk.

8. The automated expandable table as claimed in claim 7 comprises:

the second sliding linkage comprises a second sliding block and a second roller;

the second sliding block being adjacently connected to the specific secondary leaf;

the second roller being connected normal to the second sliding block, opposite the specific secondary leaf;

the second sliding block being slidably positioned within the second radial slot; and the second roller being moveably engaged within the second J-shaped slot.

9. The automated expandable table as claimed in claim 7 comprises:

the first lifting mechanism comprises a pair of guide ramps and a pair of guide wheels;

the pair of guide ramps and the pair of guide wheels being positioned in between the specific secondary leaf and the motorized actuation disk;

each of the pair of guide wheels being rotatably mounted to the motorized actuation disk;

the pair of guide wheels being peripherally positioned on the motorized actuation disk;

the second radial slot being positioned in between the pair of guide wheels;

each of the pair of guide ramps being adjacently and radially connected to the specific secondary leaf;

the pair of guide ramps being oriented away from the rotation axis of the motorized actuation disk; and the pair of guide ramps being aligned with the pair of guide wheels.

10. The automated expandable table as claimed in claim 1 comprises:

the operative coupling between the centerpiece and the guide disk through the motorized actuation disk comprises a plurality of second lifting mechanisms;

each of the plurality of second lifting mechanisms comprises a semicircular slot, a first ramp, and a second ramp;

the centerpiece and the motorized actuation disk being slidably mounted to each other along the rotation axis of the motorized actuation disk;

the plurality of second lifting mechanisms being radially distributed about the rotation axis of the motorized actuation disk;

the plurality of second lifting mechanisms being positioned in between the centerpiece and the guide disk;

the semicircular slot traversing through the motorized actuation disk;

the first ramp being adjacently connected to the centerpiece;

the second ramp being adjacently connected to guide disk;

the second ramp being positioned within the semicircular slot; and the first ramp being aligned along the semicircular slot.

11. The automated expandable table as claimed in claim 1 comprises:

wherein the plurality of primary leaves, the plurality of secondary leaves, and the centerpiece are configured into an expanded configuration;

each of the plurality of primary leaves being positioned radially offset to the rotation axis of the motorized actuation disk;

each of the plurality of secondary leaves being positioned radially offset to the rotation axis of the motorized actuation disk;

the plurality of secondary leaves being positioned interspersed through the plurality of primary leaves;

the plurality of primary leaves and the plurality of secondary leaves being perimetrically coincident with the centerpiece; and each of the plurality of secondary leaves, the centerpiece, and each of the plurality of primary leaves being positioned coplanar with each other.

12. The automated expandable table as claimed in claim 1 comprises:

wherein the plurality of primary leaves, the plurality of secondary leaves, and the centerpiece are configured into a retracted configuration;

the plurality of primary leaves being radially pressed against each other; and the plurality of secondary leaves and the centerpiece being positioned in between the plurality of primary leaves and the motorized actuation disk.

* * * * *